United States Patent [19]

Sullivan

[11] 4,385,214

[45] May 24, 1983

[54] INTERLOCK PUSHBUTTON ASSEMBLY

[75] Inventor: Jackie C. Sullivan, Asheville, N.C.

[73] Assignee: Square D Company, Palatine, Ill.

[21] Appl. No.: 293,039

[22] Filed: Aug. 14, 1981

[51] Int. Cl.[3] ..... H01H 9/26

[52] U.S. Cl. ..... 200/5 E; 200/50 C

[58] Field of Search ..... 200/5 R, 5 E, 50 C

[56] References Cited

U.S. PATENT DOCUMENTS

| | | | |
|---|---|---|---|
| 2,259,298 | 10/1941 | De Loache | 200/50 C |
| 3,312,122 | 4/1967 | Conner et al. | 200/50 C |
| 3,560,674 | 2/1971 | Lewis | 200/5 E |

*Primary Examiner*—A. T. Grimley
*Assistant Examiner*—Morris Ginsburg
*Attorney, Agent, or Firm*—W. H. Schmeling; R. T. Guttman

[57] ABSTRACT

The disclosure depicts a novel pushbutton switch mechanism having a pair of pushbutton switches with electrical contacts and an interlock mechanism between the switches. The interlock mechanism comprises; a shoulder on each of the pushbutton switches, an interlock plunger for contacting the shoulders of the pushbutton switches, and a return spring in contact with the interlock plunger for retaining the plunger in a predetermined position. A plunger support and a plunger guide in the pushbutton switch mechanism for defining an area in which the interlock plunger is contained. When one of the pushbutton switches is depressed, the interlock plunger contacts the shoulder of the other pushbutton switch thereby preventing the other pushbutton switch from being depressed simultaneously.

7 Claims, 8 Drawing Figures

INTERLOCK PUSHBUTTON ASSEMBLY

CROSS-REFERENCE TO RELATED APPLICATIONS

This application relates to, but is in no way dependent upon, co-pending application of common ownership, Ser. No. 06/292,776, filed Aug. 14, 1981.

BACKGROUND OF THE INVENTION

This invention relates, in general, to electric pushbutton switches and, in particular, to an interlock mechanism for a pair of pushbutton switches. The interlock mechanism prevents the depression of both pushbuttons simultaneously. That is, once one of the pushbuttons has been depressed, the other pushbutton is locked into its normal non-depressed position.

Numerous mechanisms for interlocking pushbuttons can be found in the prior art. The use of rocker arms is only one type of many different mechanical linkages which have been utilized. In comparison to the present invention, these prior art mechanical linkages are more complex in construction, and movement of the linkage occurs when either pushbutton switch is depressed.

This invention has general applicability but is most advantageously applied to a pair of electric pushbutton switches. The present invention has special applicability to the multiple position pushbutton switches disclosed in the referent co-pending application.

OBJECT OF THE INVENTION

It is a general object of the present invention to provide for a pair of electric pushbutton switches an improved interlock mechanism.

It is another object of the present invention to provide an interlock mechanism which requires a minimum number of parts and is easy to manufacture.

It is a further object of the present invention to provide an interlock mechanism which allows only one pushbutton of the pair of pushbuttons to be depressed at any one time.

It is another object of the present invention to provide an interlock mechanism which requires movement when only one of the two pushbutton switches is depressed.

BRIEF DESCRIPTION OF THE DRAWINGS

The features of the present invention which are believed to be novel are set forth with particularity in the appended claims. The invention, together with further objects and advantages, may best be understood by reference to the following description taken in conjunction with the accompanying drawings, in the several figures of which like reference numerals identify like elements, and in which:

DESCRIPTION OF THE PREFERRED EMBODIMENT

This invention relates to a novel pushbutton switch mechanism for use with a pair of pushbutton switches. In particular, the mechanism provides for an interlock between the two pushbutton switches such that only one pushbutton switch may be depressed at a time. The present invention will now be described. In general terms, the novel pushbutton switch mechanism is for use with a pair of pushbutton switches with electrical contacts. More specifically, an interlock mechanism is provided between the switches which comprises a shoulder on each of the pushbutton switches and an interlocking plunger for contacting the shoulders of the pushbutton switches. Furthermore, a return spring is provided in contact with the interlock plunger for retaining the plunger in a predetermined position. A plunger support and a plunger guide in the pushbutton switch mechanism is provided for defining an area in which the interlock plunger is contained. When one of the pushbutton switches is depressed, the interlock plunger contacts the shoulder of the other pushbutton switch thereby preventing the other pushbutton switch from being depressed simultaneously.

Figure 1:
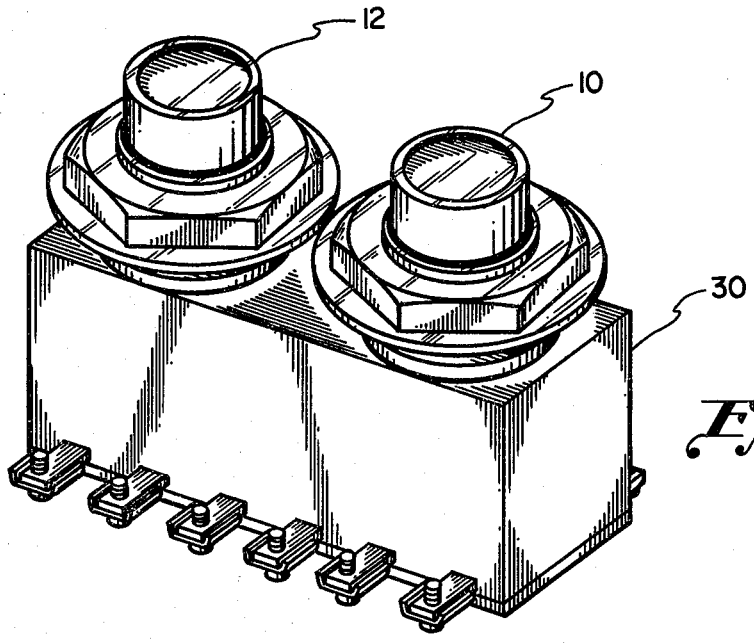
FIG. 1 is a perspective view of the pushbutton electric switch mechanism embodying the present invention.
Figure 5:
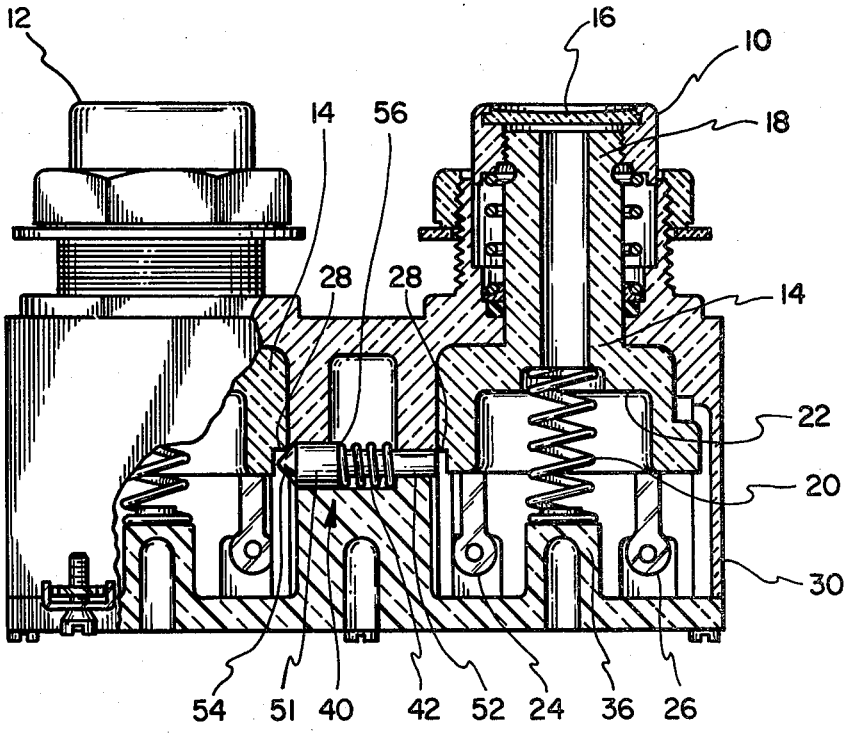
FIG. 5 is a partially cut-away view of the electric pushbutton switch mechanism illustrating the present invention; and, FIGS. 6A, 6B and 6C illustrate how the present invention operates.

FIG. 1 is a perspective view of a pair of pushbutton switches embodying the present invention. FIG. 5 is a partially cut-away view of the FIG. 1 embodiment showing the novel interlock mechanism. The novel pushbutton switch mechanism comprises first and second pushbuttons 10 and 12. Each of the pushbuttons 10 and 12 has a cam 14 with a cap 16 attached to a first end 18 of the cam 14. A cam return spring 20 is attached to a second end 22 of the cam 14. At least two sets, 24 and 26, of electrical contacts are provided and are activated by the cam 14. The cam 14 also has a shoulder 28.

A housing 30 is provided for containing each of the cams 14 of the first and second pushbuttons 10 and 12. The housing 30 has an open bottom 32. (See FIG. 2.) A cover 34 is attached to the open end 32 of the housing 30. The cover 34 has a support post 36 for each of the cam return springs 20 of the first and second pushbuttons 10 and 12. (See FIG. 4.)

Figure 3:
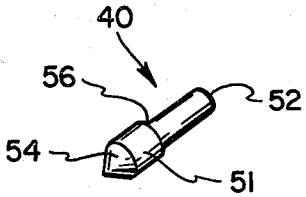
FIG. 3 is a perspective view of an interlock plunger utilized as part of the present invention.

As shown in FIGS. 3 and 5, a cylindrical interlock plunger 40 is provided for contacting the shoulders 28 of the cams 14. An interlock plunger return spring 42 is attached to the interlock plunger 40 for retaining the plunger 40 in a predetermined position.

A plunger support section 44 on the housing 30 and a plunger guide 46 on the cover 34 are provided for positioning the interlock plunger 40 and the interlock plunger return spring 42 when the cover 34 and the housing 30 are assembled.

The interlock plunger 40 has a first end 51 which is substantially larger than a second end 52. The first end 51 has an outward extending conical section 54 and the second end 52 is flat. The plunger return spring 42 contacts a rear portion 56 of the larger first end 51 and also contacts a portion of the plunger support section 44 and a portion of the plunger guide 46 when the unit is assembled, thereby retaining the plunger return spring 42 in position as shown in FIG. 5.

Figure 2:
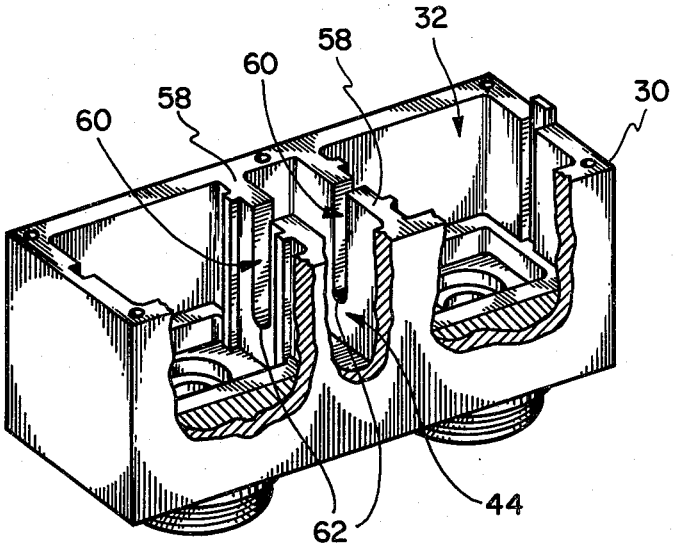
FIG. 2 is a perspective view of a housing for the pushbutton switches.
Figure 4:
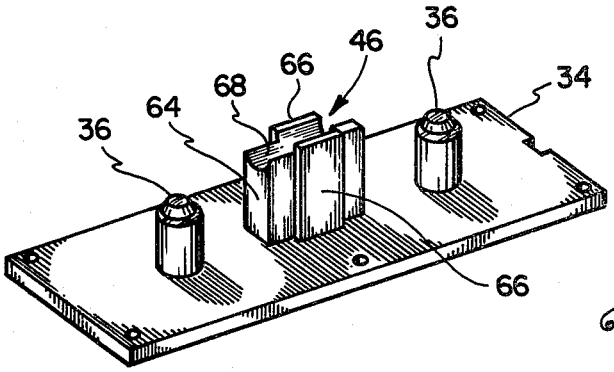
FIG. 4 is a perspective view of a cover which is used with the housing.

Referring to FIG. 2, the plunger support section comprises a pair of walls 58 with a groove 60 located substantially in the center of the walls 58. The bottom 62 of the grooves 60 is rounded to fit the configuration of the interlock plunger 40. Referring now to FIG. 4, the plunger guide 46 comprises a block 64 having a predetermined length, the ends of which fit in the grooves 60 of the plunger support section 44. The plunger guide 46 further comprises a pair of side walls 66 which fit between the walls 58 of the plunger support section 44. The top 68 of the block 64 is rounded to fit the configuration of the interlock plunger 40. When the cover 34 is assembled with the housing 30 the plunger support section 44 and the plunger guide 46 define an area in which the interlock plunger 40 and the interlock plunger return spring 42 are positioned as shown in FIG. 5. The interlock plunger 40 is held in a first predetermined position when neither of the first or second pushbuttons 10 and 12 are depressed as shown in FIG. 5.

Figure 6A:
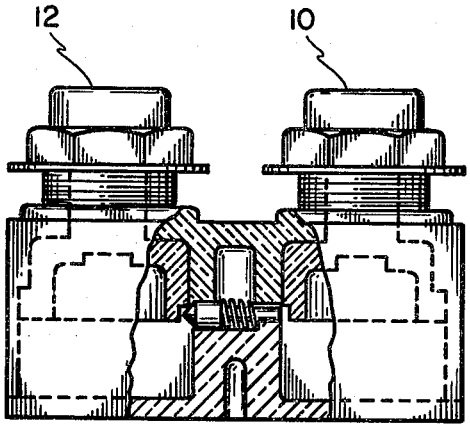
Figure 6B:
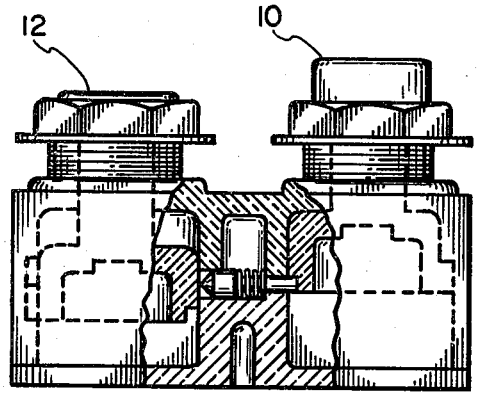
Figure 6C:
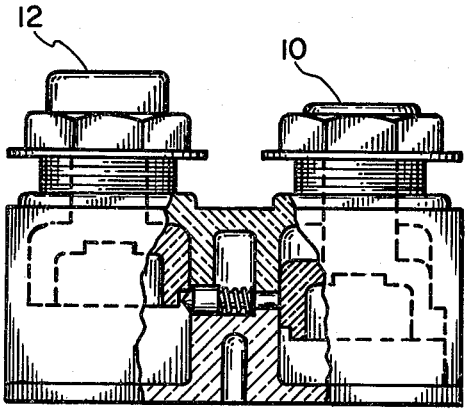

FIGS. 6A, 6B and 6C illustrate the operation of the interlock plunger 40. In FIG. 6A neither the first nor second pushbutton 10 or 12 is depressed. In this position the interlock plunger 40 occupies a first predetermined position in which the conical section 54 of the interlock plunger 40 contacts the shoulder 28 of the second pushbutton 12. FIG. 6B illustrates that when the second pushbutton 12 is depressed, the shoulder 28 of the second pushbutton 12 causes the interlock plunger 40 to move to a second predetermined position in which the second end 52 of the interlock plunger 40 contacts the shoulder 28 of the first pushbutton 10 thereby preventing the first pushbutton 10 from being depressed. In the second predetermined position the plunger return spring 42 has been compressed and when the second pushbutton 12 is released the plunger return spring 42 will cause the interlock plunger 40 to return to the first predetermined position as shown in FIG. 6A. The conical section 54 of the interlock plunger 40 allows the second pushbutton 12 to move the interlock plunger 40 when the pushbutton 12 is depressed. In FIG. 6C the first pushbutton 10 has been depressed which causes no movement of the interlock plunger 40; however, when the second pushbutton 12 is attempted to be depressed after the first pushbutton 10 has been depressed, the interlock plunger 40 is restrained from moving by a surface on the cam 14 of the first pushbutton 10 and the flat end 52. Thus, the present invention provides a novel interlock mechanism requiring few moving parts which prevents the two pushbuttons from being depressed simultaneously.

The invention is not limited to the particular details of the apparatus depicted and other modifications and applications are contemplated. Certain other changes may be made in the above-described apparatus without departing from the true spirit and scope of the invention herein involved. It is intended therefore that the subject matter in the above depiction shall be interpreted as illustrative and not in a limiting sense.

What is claimed is:

1. A pushbutton switch mechanism including a pair of pushbutton switches with electrical contacts and an interlock mechanism between the switches, each of said pair of switches having a reciprocative linearly movable pushbutton and said interlock mechanism comprising:

a shoulder on each of said pushbuttons, a reciprocatively linearly movable interlock plunger having opposite ends engagable with the shoulders on the pair of pushbuttons with a first one of said ends of the plunger having an inclined surface that is engagable with the shoulder of its associated pushbutton, a spring constantly biasing the plunger toward a position whereat the inclined surface is positioned to engage the shoulder of the associated pushbutton, and a plunger guide and support positioning the plunger and spring for reciprocal movement relative to the pushbuttons whereby when a first one of the pushbuttons is depressed the interlock plunger is positioned to engage the shoulder on a second one of said pair of pushbuttons and thereby prevent the pushbuttons of said pair from being simultaneously depressed.

2. The mechanism described in claim 1 wherein said interlock plunger occupies a first position when neither of said pushbuttons are depressed and remains in said first position when the second pushbutton is depressed, said second pushbutton preventing said interlock plunger from moving from the first position where the shoulder of said first pushbutton engages the inclined surface on said interlock plunger and thereby prevents said first pushbutton from being depressed.

3. The mechanism described in claim 1 wherein the first end of the plunger has a diameter greater than a second one of said opposite ends of the plunger, the inclined surface is provided by a taper disposed at the first end of the plunger, and one end of the spring engages an annular shoulder located intermediate the first and second ends of the plunger.

4. A pushbutton switch mechanism including a pair of pushbutton switches with electrical contacts and an interlock mechanism between the switches, each of said pair of switches having a linerally movable reciprocative pushbutton and the interlock mechanism comprising:

a shoulder on each of said pushbuttons, a reciprocatively movable interlock plunger having opposite ends engagable with the shoulders on the pair of pushbuttons with a first one of the ends of the plunger having an inclined surface that is in constant engagement with the shoulder of its associated pushbutton, a spring constantly biasing the plunger toward an at rest position whereat the inclined surface engages the shoulder of the associated pushbutton, a flat surface at a second end of the plunger positioned to be out of a path of movement of the shoulder on a second of the pair of pushbuttons when the plunger is biased by the spring to the at rest position and the second pushbutton is moved to an actuated position, and a plunger guide and support positioning the plunger and spring for reciprocal movement relative to the pushbuttons whereby when the associated pushbutton is depressed the plunger moves to a position where the second end of the plunger is positioned to engage the shoulder on the second pushbutton.

5. A pushbutton switch mechanism including: a pair of electrical switches with each of said switches having electrical contacts and a linearly movable pushbutton for actuating the contacts, a housing for the switches with said housing having an open bottom end, a cover closing the open bottom end of the housing and an interlock mechanism including a plunger and a spring positioned between the pushbuttons for preventing simultaneous movement of the pair of pushbuttons to a contact actuating position, said interlock mechanism including a shoulder on each of the pushbuttons and a taper on end of the plunger;

a support and guide provided by the housing and the cover positioning the plunger and spring between the pushbuttons at a position where the taper constantly engages the shoulder on its associated pushbutton.

6. A pushbutton switch mechanism including a pair of electrical switches and an interlock mechanism preventing simultaneous operation of the switches, each of said switches including; a linearly movable reciprocative pushbutton, a pair of contacts movable to a circuit closing position in response to movement of the pushbutton, a shoulder on the pushbutton, and a spring biasing the pushbutton to an at rest position, a reciprocatively movable interlock plunger having opposite ends engagable with the shoulders on the pair of pushbuttons with a first one of the ends of the plunger having an inclined surface that is in constant engagement with the shoulder of its associated pushbutton, a spring constantly biasing the plunger toward the at rest position whereat the inclined surface engages the shoulder of the associated pushbutton, and a plunger guide and support positioning the plunger and spring for reciprocal movement relative to the pushbuttons whereby when a first one of the pushbuttons is depressed the interlock plunger is positioned to engage the shoulder on a second one of said pair of pushbuttons and thereby prevent the pushbuttons of said pair from being simultaneously depressed.

7. The mechanism described in claim 6 wherein said interlock plunger occupies a first position when neither of said pushbuttons are depressed and remains in said first position when the second pushbutton is depressed, said second pushbutton preventing said interlock plunger from moving from the first position where the shoulder of said first pushbutton engages the inclined surface on said interlock plunger and thereby prevents said first pushbutton from being depressed.

* * * * *